United States Patent [19]

Gengenbach et al.

[11] Patent Number: 4,594,489

[45] Date of Patent: Jun. 10, 1986

[54] ELECTRICAL SWITCHING ELEMENT

[75] Inventors: Bruno Gengenbach; Carl-Ludwig Meyer; Roland Michal, all of Pforzheim; Ferenc Remenyi, Viernheim, all of Fed. Rep. of Germany

[73] Assignee: Doduco KG Dr. Eugen Durrwachter, Pforzheim, Fed. Rep. of Germany

[21] Appl. No.: 693,119

[22] Filed: Jan. 22, 1985

[30] Foreign Application Priority Data

Jan. 25, 1984 [DE] Fed. Rep. of Germany ..... 3402371
Jan. 25, 1984 [DE] Fed. Rep. of Germany ..... 3402372

[51] Int. Cl.[4] ..... H01H 33/06

[52] U.S. Cl. ..... 200/151; 200/145; 200/144 R; 200/149 A

[58] Field of Search ..... 200/151, 145, 144 R, 200/149 A

[56] References Cited

U.S. PATENT DOCUMENTS 1,629,640 5/1927 Schachtner ..... 200/151
1,866,563 7/1932 Hammell ..... 200/151
2,191,501 2/1940 Schmidt ..... 200/151

FOREIGN PATENT DOCUMENTS 1134446 8/1962 Fed. Rep. of Germany ..... 200/151
1959538 6/1971 Fed. Rep. of Germany ..... 200/151

*Primary Examiner*—Robert S. Macon
*Attorney, Agent, or Firm*—Balogh, Osann, Kramer, Dvorak, Genova & Traub

[57] ABSTRACT

The load-isolating switch comprises two coaxial electrodes 1 and 2, which are mechanically connected by an interposed insulator 3. A cam 4 is provided on the insulator 3 and is spanned by at least one contact bridge 5, which is axially displaceable by an axially displaceable slider 10, which has coupling elements 13, 14 for engaging the or each contact bridge 5. In one position the or each contact bridge 5 is in contact with both electrodes 1 and 2. The or each contact bridge is adapted to slide up on an inclined surface 4*a* of the cam to disengage the contact bridge 5 from one of said electrodes and is movable to a second position in which said slider is disengaged from at least said one electrode.

28 Claims, 10 Drawing Figures

ELECTRICAL SWITCHING ELEMENT

BACKGROUND OF THE INVENTION

1. Field of the Invention

This invention comprises a switching element, particularly for use as a load-isolating switch in low-voltage switchgear, which switching element comprises contact-bridging means for electrically connecting two stationary electrical terminals.

2. Description of the Prior Art

In low-voltage switchgear, particularly in power-distributing apparatus, switchgear and control systems it is known to provide load-isolating switches for making and breaking circuits carrying rated currents and overcurrents, e.g., in association with transformers, motors, capacitors etc. Such load-isolating switches are either installed in open racks or encapsulated in housings. In known low-voltage load-isolating switches the contact-bridging means between stationary electrical terminals usually comprise pairs of parallel disconnecting knives, which are pivoted to one of the electrical terminals. The known switching elements of that kind are relatively bulky and consist of numerous individual parts.

SUMMARY OF THE INVENTION

It is an object of the invention to provide a switching element which is particularly suitable for use as a low-voltage load-isolating switch and which is compact and consists only of a small number of components.

This object is accomplished by a switching element which is of the kind described first hereinbefore and in which

- the two terminals consist of respective electrodes, which are coaxial to each other and axially spaced apart and are mechanically connected by an insulator, which is coaxial to and disposed between said electrodes,
- the contact-bridging means comprise at least one axially displaceable contact bridge, which carries two axially spaced apart, electrically interconnected contacts, which are engageable with the two electrodes under the force of springs,
- an electrically insulating cam is provided on the insulator under the or each contact bridge and has an inclined surface facing one end of the or each contact bridge,
- a slider is provided, which is axially slidable along the axis of the electrodes and comprises coupling elements for acting on respective ends of the or each contact bridge, said slider being reciprocable between a first position, in which the or each contact bridge is in contact with both electrodes, and a second position, in which one contact of the or each contact bridge engages said cam and is spaced from one of the electrodes, thereinafter described as the "first electrode", and
- the or each contact bridge is adapted to slide on said inclined surface of said cam during the movement of said slider from said first position to said second position so as to disengage said contact bridge from said first electrode.

In the switching element in accordance with the invention the electrical terminals consist of two coaxial rod-shaped electrodes, which are axially spaced apart and are mechanically connected by an interposed coaxial insulator. The two electrodes and the insulator constitute a compact structural unit, which may be used as the carrier of the switching element. The insulator is spanned by at least one electrically conducting contact bridge, which has two contacts, which are engageable with the two electrodes under the force of springs. The springs may abut on the slider provided for the actuation of the contact bridge. If a plurality of contact bridges are arranged around the electrodes, the springs may consist of spring rings, which surround all contact bridges and urge the contact bridges radially against the electrodes. The simplicity and compactness of the structure of the switching element will be improved if the or each contact bridge is not pivoted to one of the electrodes but is radially and axially movable in the space between the electrodes and the slider and the contact bridge is held and guided by the structural cooperation of the electrodes, the slider, and the springs provided between the electrodes and the slider For this purpose the slider is suitably provided with guiding elements, by which the contact bridge is radially and axially guided on both sides so that the contact bridge extends generally along the electrodes (claim 10). Said guiding elements need not extend on both sides of the contact bridge throughout the length of the latter but it will be sufficient to guide the contact bridge only in part of its length, suitably near its two ends.

The or each contact bridge is actuated in that the slider is axially displaced so that its coupling elements act on one or the other end of the contact bridge. As the contact bridge slides along the electrodes, one end of the contact bridge moves away from the insulator and the other end of the contact bridge moves toward the insulator and close to the insulator disengages from the first electrode to interrupt the previously closed circuit. As one contact of the contact bridge is lifted from the periphery of the first electrode, an insulating gap is provided between the terminals of the switch so that the switching element can be used in isolating switches. The isolating distance between the terminals of the switch depends on the length of the insulator, on the displacement of the slider and on the configuration of the cam, which is provided on the insulator under the contact bridge or bridges and has an inclined surface which faces that end of the or each contact bridge which is associated with the first electrode. The contact bridge slides up on that inclined surface with a portion which is close to that end of the contact bridge which is associated with the first electrode. As a result, that end of the contact bridge is disengaged from the first electrode and the contacts are separated more quickly and in a more favorable manner than in a switching element in which the contact bridge is not lifted from the electrode but slides on an insulator which has the same thickness as the electrodes. It will be understood that the cam must not constitute an electrically conducting bridge between the two electrodes but the or each contact bridge spans not only the insulator but also the cam and for this reason has a suitable intermediate portion, which is, i.e., arcuate so that the cam can extend under the or each contact bridge. Alternatively, the intermediate portion of the or each contact bridge may extend through a longitudinally extending groove formed in the cam.

In the simplest case the switching element in accordance with the invention consists only of a few parts comprising two electrodes, an insulator interposed between the electrodes, a cam, which in the simplest case may consist of a portion of the insulator, at least one contact-carrying contact bridge, and springs. Such switching element is compact and can be actuated in a simple manner. When the switching element is used in a load-isolating switch, as is preferred, the manufacturing costs of such load-isolating switch can be drastically reduced owing to the simple structure of the switching element in accordance with the invention.

The slider is reciprocable between two positions. In the first position, the two contacts of the or each contact bridge contact the peripheral surfaces of the two electrodes so that there is a conducting path between the two electrodes. In the second position of the slider, at least one contact of the or each contact bridge is disengaged from the associated electrode and bears on the cam. The second contact of the contact bridge may remain in contact with the other electrode. If a particularly high dielectric strength is required for the switching element, another cam may be provided between the above-mentioned cam and the second contact of the contact bridge and may have a second inclined surface, which is disposed under the or each contact bridge and faces the same end of the contact bridge as the inclined surface of the first cam and during a displacement of the slider in the opening sense cooperates with the or each contact bridge to lift the second contact of the contact bridge from the second electrode so that the contact bridge has been lifted from both electrodes in the open position of the switching element. In an alternative arrangement the second electrode has a length section which is spaced from the axially inner end of the second electrode and which is smaller in diameter than the remainder of said second electrode and in the closed position of the switching element the second contact of the or each contact bridge contacts the thicker, axially inner length section of the second electrode whereas the switching element can be opened in that the or each contact bridge is so moved that its second contact is disposed over the adjoining thinner length section of the second electrode but a contact of the second contact with that thinner length section is prevented by a projection that is provided on the slider and extends between that second contact and that thinner length section.

The dielectric strength of the switching element can also be increased in that the other electrode, which is described here as the "second electrode", has an electrically insulating surface portion spaced from the insulator disposed between the two electrodes and the second contact of the or each contact bridge bears on that insulating surface portion in the second position of the slider. In that arrangement the distance between the insulator and the insulating surface portion of the second electrode is so large that during the movement of the slider in the opening sense the or each contact bridge will not contact the insulating surface portion until the contact bridge has been lifted from the first electrode (claim 2). In that case each contact bridge is electrically insulated from both electrodes in the second or "open" position of the switching element and it is not necessary to lift the contact bridge from the second electrode because the making and breaking operations are carried out on the first electrode whereas the switching on the second electrode is always effected under no load.

Because the contact associated with the second electrode is electrically disconnected from that electrode after the contact associated with the first electrode is electrically disconnected from the first electrode, the switching element has a higher dielectric strength, which is desirable in numerous cases because arcing adjacent to the first electrode may result in a deposition of soot, which permits undesirable creep currents. There will be no arcing on the second electrode so that the deposition of soot on the second electrode will be avoided or at least reduced.

In accordance with a preferred further feature within the scope of the invention, the first electrode comprises length sections consisting of or coated with different electrically conducting materials. Specifically, an axially inner or first length section adjoining the insulator consists of a material which exhibits a favorable behavior under the action of an electric arc, and an axially outer length section which adjoins the axially inner length section and is contacted by the or each contact bridge in its first position consists of a material which exhibits a desirable behavior when flown through by a continuous current and particularly will not be weldable under such conditions (claim 3). In that case different contact materials can be selected which have optimum properties for carrying a continuous current and for the breaking operation, respectively. As the switching element is actuated in an opening sense, an electric arc may be struck at the first length section of the electrode and that first length section may desirably consist of composite materials such as Cu/W or Ag/W (claim 5) or Ag/WC or Ag/Ni. Materials which are particularly suitable for the second length section of the electrode include, e.g., Ag/C, Ag/CdO, Ag/$SnO_2$, Ag/$SnO_2$/$In_2O_3$, Ag/$SnO_2$/$WO_3$ (claim 4). In the present switching element the making operation is preferably effected on the second rather than on the first length section of the first electrode. This can be accomplished in that the displacement of the slider, the length of the first length section of the first electrode, which first length section adjoins the insulator, and the length of that portion of the or each contact bridge which spans the cam, are so selected in consideration of each other that the contact which is secured to one end of the or each contact bridge and is to be lifted from the first electrode will be in contact with the second length section of the first electrode in the first or closed position of the switching element (FIG. 4) and will have been lifted from the first electrode in the second or open position of the switching element (FIG. 6) and will contact with the first length section of the first electrode in an intermediate position (claim 7). In that case, current is carried by the first length section of the first electrode only during the breaking operation and by the second length section of the first electrode only during the making operation and in case of a continuous current.

Because the electrodes are coaxial and are mechanically connected by the interposed insulator, the slider can be directly mounted on the electrodes and can be guided by the electrodes during its displacement (claim 11). Such an arrangement contributes greatly to a compact structure of the switching element.

Arc-quenching features known per se in known load-isolating switches can be embodied in the novel switching element. For instance, an arc-quenching chamber may be provided, which is defined by arc-quenching sheet metal elements and into which the electric arc struck as the switching element is actuated in an opening sense is urged by a blowing magnetic field or by self-generated or extraneously generated compressed air. In a preferred arrangement the slider defines an internal switching and arc-quenching chamber (claim 12). This will be of special advantage because the contact bridges must be accommodated in the slider in any case so that the latter can easily be designed so to define an enclosed or substantially enclosed chamber, Particularly if the slider defines an internal switching and arc-quenching chamber and if the electrodes are used to advantage as means for guiding the slider, the slider will desirably be designed so that it encloses or at least surrounds the electrodes (claim 13). The walls defining the chamber may be made of a material which will generate arc-quenching gases under the action of an electric arc (claim 14), as is known, e.g., with so-called hard gas switches. To permit an escape of the arc-quenching gases from the switching and arc-quenching chamber, that chamber is suitably defined by preforated walls (claim 15).

Because the switching element is actuated by a displacement of the slider in the axial direction of the electrodes, slots may be provided at that end of the slider which is adjacent to the first electrode, particularly if the slider defines a chamber, and one or more sheet metal elements for quenching an electric arc that has been struck may be axially inserted through said slots into the space between the first electrode and the adjacent end of the or each contact bridge when that end has been lifted from said electrode (claim 16). The quenching of an electric arc may also be assisted in that that coupling element of the slider which acts on that end of the or each contact bridge which is associated with the first electrode may be arranged to engage the insulating cam when the slider is in its second or open position; in that case the electric arc struck between the lifted end of the contact bridge and the first electrode will be constructed between the cam and that coupling element with which the slider engages the cam. In that case it will also be desirable to provide a slider which defines an internal switching chamber because in that case the electric arc cannot flash over beyond the slider onto the electrode from which the bridge contact has been lifted.

The two control positions of the switching element are desirably defined by an indirect or direct engagement of the slider with the cam disposed between the electrodes. In the open position this engagement desirably effected in that the cam is engaged by that coupling element of the slider which is adjacent to the first electrode. In the closed position, this engagement is desirably effected in that the or each contact bridge engages the opposite end of the cam so that the displacement of the slider is also limited as the slider also engages the or each contact bridge.

In order to ensure that the switching element will be resiliently locked in the open position, the cam has suitably a second inclined surface, which faces away from that end of the or each contact bridge which is faced by the first inclined surface, i.e., the second inclined surface faces the opposite end of the or each contact bridge (claim 17). The first and second inclined surfaces have in longitudinal section the configuration of a gable roof, the apex of which is so arranged that as the or each contact bridge is moved to its open position a projection provided on the radially inner side of the or each contact bridge moves beyond said apex into engagement with the second inclined surface. The inclinations of the two inclined surfaces and the radius of curvature of the arcuate surface joining the two inclined surfaces will depend on predeterminable actuating forces. The above-mentioned projection on the radially inner side of the or each contact bridge is suitably constituted by that portion with which the contact bridge is slidable on the first inclined surface of the cam so that that end of the contact bridge which is liftable from the first electrode will remain entirely in the air when said end has been lifted from the first electrode.

Instead of a second inclined surface, a shallow depression might be provided on the cam near its apex and the contact bridge might be provided on its radially inner side with a projection received by said depression as the contact bridge reaches its open position.

The switching element in accordance with the invention may constitute a multipole switch and in that case comprises a plurality of juxtaposed contact bridges, which extend along the axis of the electrodes and are actuated by one and the same slider (claim 18). In such an arrangement the bridge contacts may be juxaposed in a plane and may contact two flat electrodes having a suitable width. In a preferred arrangement, the plurality of contact bridges are arranged in an annular series around the electrodes (claim 19). In a particularly preferred arrangement, the annular series of contact bridges is symmetrical with respect to the axis of the electrodes. In that case the slider consists suitably of a sleeve, which concentrically surrounds the electrodes and surrounds all contact bridges (claim 20). That sleeve may be open at both ends or may be closed or substantially closed at both ends to define an internal switching chamber. If the contact bridges are arranged in an annular series, particularly in a concentric annular series, the contact bridges may be urged against the electrodes by radially acting spring rings. Two of such spring rings are suitably provided and one of said spring rings urges corresponding ends of the contact bridges against one electrode whereas the other spring ring urges corresponding ends of the contact bridges against the other electrode. To facilitate the actuation of the switching element in an opening sense, the spring rings should be made of elastomeric material rather than of metal and the restoring force of the spring rings should increase only moderately as the contact bridges are progressively lifted from the surface of the first electrode. Alternatively, radially acting coil springs may be provided, which at one end abut on the radially outer side of the contact bridges and at the other end abut on the inside surface of the tubular slider whereas each coil is guided on its sides between guiding walls which extend axially and radially in the tubular slider. That portion of the contact bridges which is abutted by the coil springs is suitably provided with a projection, which extends radially into the associated coil spring to prevent it from slipping on the contact bridge.

The force required to hold the switching element in a closed position may alternatively be generated by a leaf spring associated with the or each contact bridge and acting radially on the liftable end of the contact bridge (claim 21). If an annular series of contact bridges is provided, an annular series of leaf springs will be provided. In a preferred arrangement, one leaf spring or a plurality of leaf springs are held so that they are not displaceable. For this purpose the or each leaf spring is fixed at one end to that electrode toward which the contact bridge is urged by the other end of the leaf spring. That other end of the leaf spring is suitably bent up to be inclined away from the electrode (claim 22). If this concept is adopted with an annular series of leaf springs, such annular series will flare like a cup. The or each leaf spring may terminate short of the associated contact bridge at such a location that the or each leaf spring will release the associated contact bridge during the opening movement of the switching element before that contact bridge slides up on the cam and is thus lifted from the electrode. In that case the leaf spring will not oppose the lifting of the contact bridge from the electrode but will exert an adequate contact-closing force. In such an arrangement the slider may be used to guide and support the leaf spring(s). The design of the leaf spring(s) may be so selected in adaptation to the slider that the or each leaf spring will be raised and will thus relieve the associated contact bridge during the opening movement of the switching element.

If a plurality of contact bridges are provided, which are arranged in an annular series surrounding the electrodes, the cams suitably constitute a ring, which surrounds the insulator or is part of the insulator (claim 23).

If the switching element in accordance with the invention comprises a plurality of contact bridges, the currents to be switched may be distributed to a plurality of parallel conducting paths and a plurality of parallel conducting paths may be interrupted at the same time or a single conducting path may be interrupted at a plurality of locations. In that case each electrode is separated into axially extending segments, which are insulated from each other and have juxtaposed surface portions facing respective contact bridges (claim 25). A multiphase switch will then be obtained if the two electrodes are similarly divided and are oriented so that their segments are aligned in pairs and at least one contact bridge is associated with each of said pairs of aligned segments. For instance, a three-phase switch will be obtained if each electrode is divided into three segments. If electrodes thus divided into three segments are so oriented that the axial center lines of the segments of one electrode are aligned with the insulating portions disposed between adjacent segments of the other electrode and if five contact bridges are so associated with such electrode array that two contact bridges extending from one segment of one electrode contact two adjacent segments of the opposite electrode, a meandering conducting path will be provided between the electrodes and said conducting path can be interrupted at any of five locations connected in series. Another advantage afforded by the provision of an annular series of contact bridges surrounding the electrode resides in that a set of parallel conducting paths can be obtained so that currents flowing in the same direction will generate electrodynamic forces which increase the contact pressure because parallel electrical conductors which carry currents flowing in the same direction will attract each other. That effect can be increased if a ferromagnetic ring made particularly of soft iron extends radially inwardly of the annular series of contact bridges and each contact bridge is straddled by a U-shaped ferromagnetic element having legs which extend on opposite sides of the contact bridge toward the ring (claim 26). The resulting magnetic force contributing to the contact-closing force will reduce the tendency of the contacts to chatter as they close and may prevent a lifting of the contact by electromagnetic forces generated by short-circuit currents.

The switching element permits a simple arrangement of preliminary and main contacts; this will be desirable if the switching element is used in a load-isolating switch. In that case, a plurality of juxtaposed contact bridges are provided and are so designed and arranged in consideration of the coupling elements of the slider and in consideration of the cam that a movement of the slider in the opening sense will cause at least one of the contact bridges to be lifted from the first electrode after the other contact bridges and that a movement of the slider in the closing sense will cause that one contact bridge to close the circuit before the other contact bridges (claim 27). In that case the liftable contact carried by said contact bridge may be used as a preliminary contact and for this purpose may be made of a material which has a suitably high resistance to burning. A delayed opening of that contact bridge can be effected, e.g., in that the distance from that portion of that contact bridge which is to slide on the inclined surface of the associated cam is larger than with the other contact bridges so that that contact bridge will engage the inclined surface of the associated cam after the remaining contact bridges.

The ability of switching elements in accordance with the invention to quench electric arcs may be improved in that the first electrode from which one contact of the or each contact bridge is lifted as the switching element is actuated in the opening sense has an axially inner length section which adjoins the insulator and is made of or coated with a composite material which comprises a metal having a high electrical conductivity and one or more substances which under the action of an electric arc release gases which promote the quenching of the electric arc.

Such composite materials are known, e.g., from U.S. Pat. No. 4,011,426, Published German Application No. 26 47 822, Published German Application No. 16 65 019 and the prior German Patent Application No. 33 12 852, which is no prior publication.

The use of such composite material which is electrically conductive and has arc-quenching properties in the switching element in accordance with the invention is claimed herein and affords the advantage that any electric arc struck between the first electrode and a contact bridge as the latter is lifted off will be in direct contact with a material which has arc-quenching properties and can be quenched without being urged into an arc-quenching device as is usually required. In the numerous applications in which the provision of the first electrode with a length section having arc-quenching properties is sufficient to quench the electric arc, that measure will result in a much simpler and very compact switching element.

An electrode comprising arc-quenching material may generally be used in all embodiments of the switching element which have been described hereinbefore and are defined in the claims. Specifically, the arc-quenching action of the composite material may be supplemented by the provision of a slider which on surfaces facing the electrodes and contact bridges consists entirely or in part of materials which will release additional arc-quenching gases under the action of an electric arc. If the current load is not excessive, the switching element can be closed in that a contact is made directly with the composite material which comprises arc-quenching substances. But such composite materials do not have such a high current-carrying capacity as conventional contact materials having a high electrical conductivity. For this reason the displacement of the slider, the length of the electrode length consisting of or provided with the composite material, and the length of that section of the contact bridge which spans the cam are preferably so selected in consideration to each other in the switching element in accordance with the invention that the contact which is carried by the contact bridge at one end thereof and is liftable from the first electrode will bear on the axially outer or second length section of the first electrode, which second length section contains no arc-quenching substances, when the switching element is in its first or open position, that contact will have been lifted from the first electrode when the contact bridge is in its second or open position, and that contact will bear on the length section consisting of or provided with the composite material when the contact bridge is in an intermediate position (claim 7). In such an arrangement the composite material will carry current only during the switching operations but will not carry a continuous current.

To minimize the length of the contact bridges, the cam for raising the contact bridge is desirably not fixed to the insulator but is mounted thereon to be axially slidable between two stationary stops (claim 8). In that case the intermediate portion with which the or each contact bridge spans the cam need not be substantially longer than the cam so that the design of a compact switching element will be facilitated. The length and displacement of the cam and the length of the electrode length section which consists of or is coated with the composite material are desirably so selected in consideration of each other that the cam will cover the first length section of the electrode, which length section comprises the composite material, when the contact bridge is in its first or closed position (claim 9). In that case the release of arc-quenching gases by the composite material will be prevented in a desirable manner when the contact bridge is in its open position. If the slider of such switching element is displaced to open the switching element, each contact bridge which is actuated by the slider will engage one inclined surface of the associated cam and will displace that cam until the displacement of the latter is limited by the engagement of the cam with the opposite stop. During that displacement of the cam that contact of the contact bridge which is to be lifted from the first electrode can slide onto that length section of the first electrode which comprises the composite material and which has been exposed by the displacement of the cam. Only when the displacement of the cam has been terminated will the contact bridge slide up on the inclined surface of the cam so that the contact bridge will move away from the electrode section comprising the composite material and any arc will be struck in the desired manner from the composite material having the arc-quenching properties.

During an actuation of the switching element in the closing sense, the contact bridge will displace the cam in the opposite direction to its other end position. If an actuation of the switching element in the closing sense should not result in a closing of the circuit at the composite material having arc-quenching properties but the circuit should be closed at the axially outer electrode length section having no arc-quenching properties, measures must be adopted which during an actuation of the switching element in the closing sense will prevent a downward or inward movement of the contact bridge on that inclined surface of the cam which faces the lifted contact of the contact bridge toward the first electrode before the associated cam has reached its end position in which said cam covers the first length section of the first electrode, which first length section consists of the composite material. This can be achieved in a simple manner, e.g., in that the cam is formed with two inclined surfaces, which face respective ends of the or each contact bridge.

Such a design of the cam has been described hereinbefore and will be claimed herein. The dimensions of the cam and its displacement will be so selected that a projection provided on the contact bridge and slidable on the cam will move beyond the apex of the cam before the contact bridge reaches the open position so that the contact bridge will then be resiliently locked in a position from which the lifted contact bridge can be actuated to move the cam back to its initial position, in which the cam covers the electrode length section which comprises the arc-quenching composite material.

If the switching element comprises cylindrical electrodes and a slider which encloses or at least surrounds the electrodes and has guiding elements for guiding the or each contact bridge on its sides, it will be possible to mount the slider so that it is rotatable about the longitudinal axis of the electrode. In that case a rotation of the slider about the electrodes will be imparted to the contact bridges. This feature can be utilized to advantage to ensure a rather uniform consumption of the composite material comprising the arc-quenching substances. Such composite materials tend to be consumed more rapidly than pure metals so that it is not desirable always to strike the electric arc from one and the same portion of the length section which comprises the arc-quenching composite materials but to intermittently shift the locations from which the electric arc is struck. This can be effected with a rotatable slider. The slider is suitably coupled to mechanical transmission elements in such a manner that each axial displacement of the slider in the opening sense will be accompanied by a predetermined angular movement of the slider. Mechanical transmission elements for performing such compound movements are known in the art.

DETAILED DESCRIPTION OF THE PREFERRED EMBODIMENTS

Figure 1:
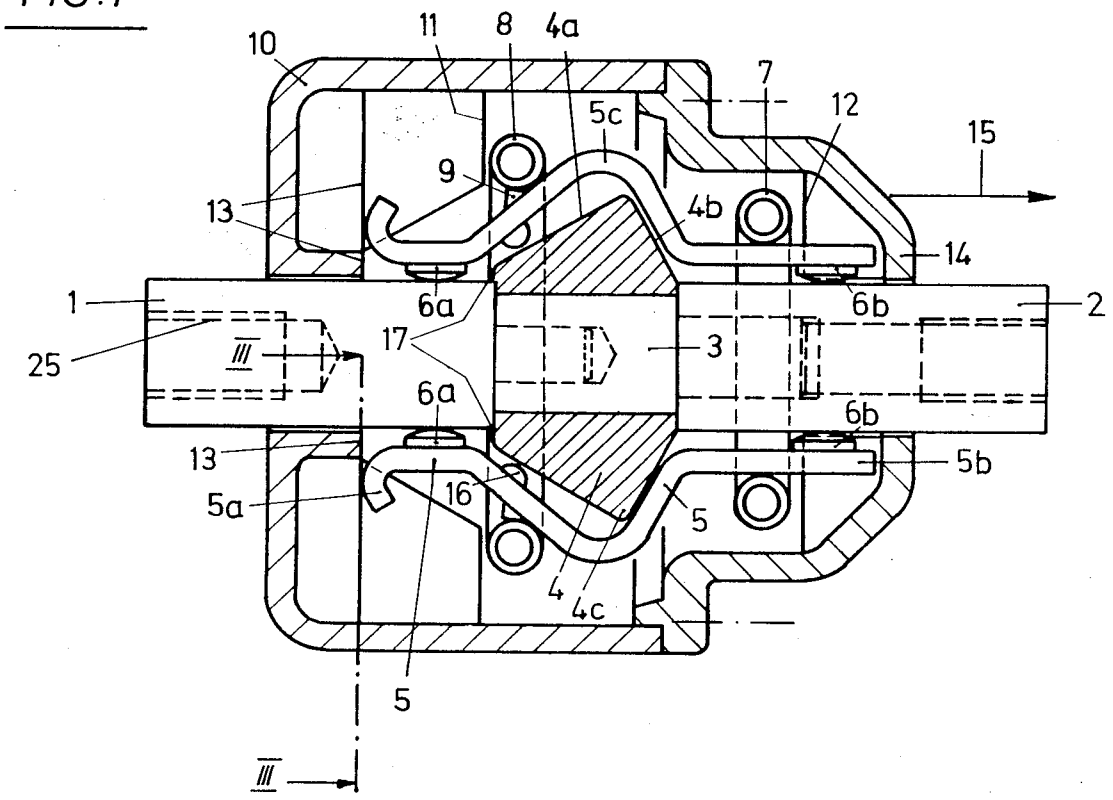
FIG. 1 is a longitudinal sectional view showing a switching element in its closed position.

Illustrative embodiments of the invention are diagrammatically illustrated in the drawing and will now be described.

In the figures showing different embodiments, identical or corresponding parts are designated by the same reference characters.

Figure 2:
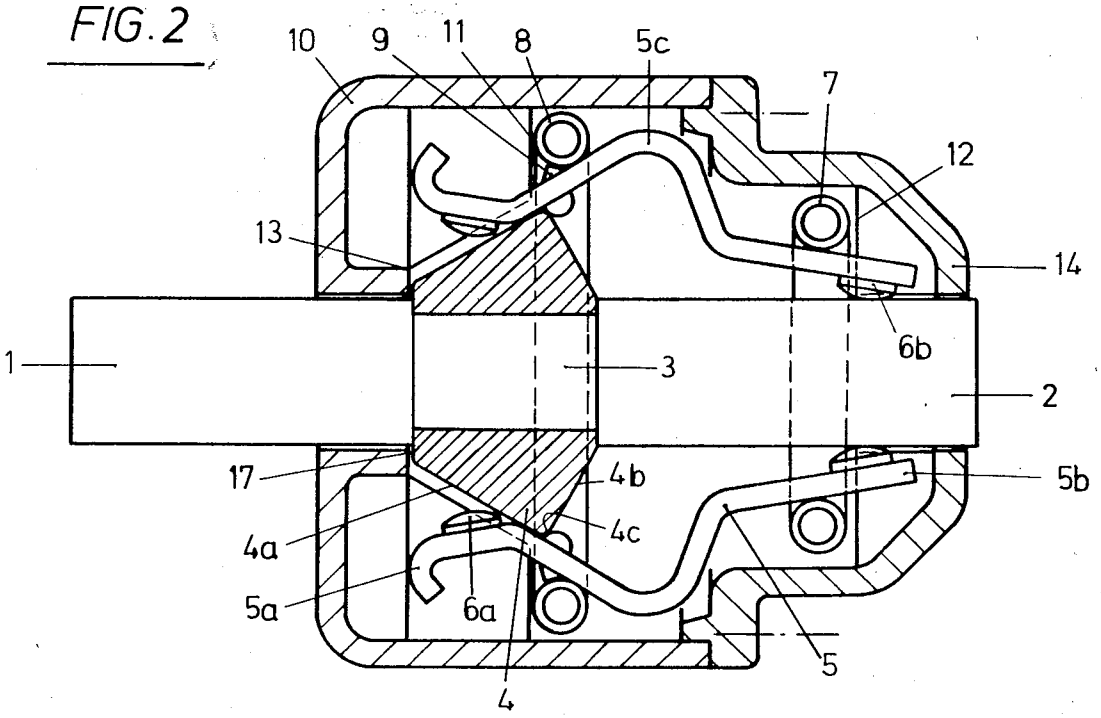
FIG. 2 is a longitudinal sectional view showing the same switching element in an open position.
Figure 3:
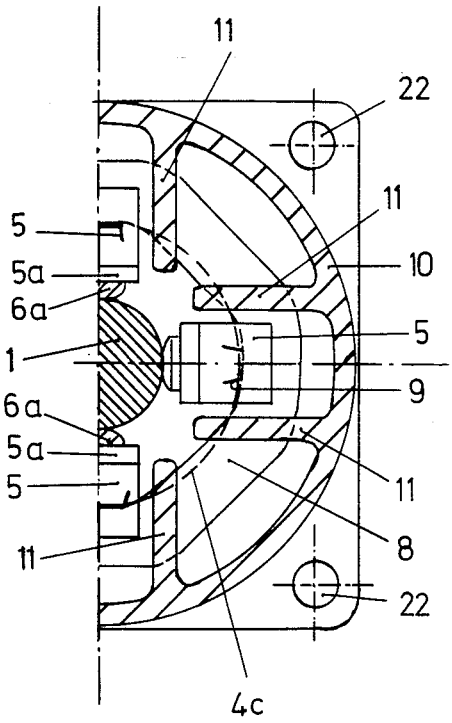
FIG. 3 is a transverse sectional view taken on line III—III in FIG. 1 and showing the switching element in a closed position.

The switching element shown in FIGS. 1 to 3 is particularly suitable for use as a load-isolating switch in low-voltage switchgear and comprises two cylindrical electrodes 1 and 2 having the same diameter. The electrodes 1 and 2 are rigidly interconnected by a cylindrical insulator 3, which is somewhat smaller in diameter than the electrodes. A ring 4 is mounted on the insulator and is formed at its periphery with two annular inclined surfaces 4*a* and 4*b* adjacent to the first electrode 1 and the second electrode 2, respectively. The ring 4 is also made of insulating material and its largest diameter is approximately twice the diameter of the electrodes 1 and 2. The assembly consisting of the electrodes 1 and 2, the insulator 3 and the ring 4 is surrounded by an annular series of four identical contact bridges 5, which are equally spaced apart around the electrodes 1 and 2. Each of the contact bridges 5 has opposite end portions 5*a* and 5*b*, which carry respective contact pieces 6*a* and 6*b*, which in the closed position of the switching element are in contact with the peripheral surfaces of the electrodes 1 and 2, respectively (FIG. 1).

Each contact bridge 5 has an outwardly curved intermediate portion 5*c*, which spans the ring 4. The contact bridges 5 are forced toward the electrodes 1 and 2 by two tubular rings 7 and 8, which are made of elastomeric material and surround the annular series of contact bridges 5 at two axially spaced apart points close to the contact pieces 6*a* and 6*b*, respectively, and exert radially inwardly directed forces on the contact bridges 5. One tubular ring 7 engages the contact bridges 5 at portions thereof which are generally parallel to the axis of the electrodes so that the tubular ring 7 does not require additional supporting means. The other tubular ring 8 engages the contact bridges 5 on portions which extend along the inclined surface 4*a* of the ring 4 with an inclination to the axis of the electrodes 1, 2. A slipping down of the ring 8 on the inclined portions of the contact bridges 5 is prevented by projections 9 provided on the radially outer side of the contact bridges 5.

A sleeve 10 is axially slidably mounted on the electrodes 1 and 2 and surrounds the annular series of the four contact bridges 5. The sleeve 10 is provided on its inside peripheral surface with two axially spaced apart sets of walls 11 and 12, which are parallel to the axis of the electrodes 1, 2. Each of the sets comprises four pairs of walls 11 or 12 and said pairs are spaced approximately 90° apart, like the contact bridges 5. Each contact bridge 5 is received near its two ends 5*a* and 5*b* between the walls 11 or 12 of respective pairs with a small lateral clearance and is thus guided by said walls during the switching movement and is held by said walls to extend along the electrodes 1 and 2. The walls 11 and 12 have end faces which are transverse to the axis of the electrodes 1 and 2 and serve as coupling elements for carrying the tubular ring 8 along during the opening operation and for carrying the tubular ring 7 along during the closing operation of the switching element. The outside peripheral surface of the sleeve 10 is suitably rotationally symmetrical with respect to the longitudinal axis of the electrodes 1 and 2.

A displacement of the sleeve 10 is imparted to the contact bridges 5. The coupling element for engaging one end 5*a* of each contact bridge is formed by a radially and axially extending wall 13, which extends from the inside surface of the sleeve 10 near one end thereof. The coupling element for engaging the opposite end 5*b* of each contact bridge is formed by the opposite end wall 14 of the sleeve.

The switching element can be actuated in the opening sense by a displacement of the sleeve 10 in the direction of the arrow 15 so that the coupling elements 13 of the sleeve 10 act on the ends 5*a* of the contact bridges and actuate the latter. During that displacement from the closed position shown in FIG. 1, rounded projections 16 provided on the inside of respective contact bridges 5 close to the projections 9 engage the inclined surface 4*a* of the ring 4 and slide up on said inclined surface 4*a* to lift the contact pieces 6*a* provided at the ends 5*a* of the contact bridges from the first electrode 1. As a result, the ring 4 acts as a cam for lifting the four contact bridges 5. As the displacement of the sleeve 10 in the direction of the arrow 15 proceeds, each projection 16 is moved past that portion 4*c* in which the ring 4 has the largest diameter and the projection 16 then slides down a small distance on the adjoining inclined surface 4*b* until the movement is interrupted by the engagement of the coupling element 13 with a confronting annular end face 17 of the cam; that end face protrudes radially from the first electrode 1. The open position which has now been reached is shown in FIG. 2. In that position the projections 16 have moved beyond that portion 4*c* of the ring 4 in which the latter has the largest diameter so that the contact bridges 5 are resiliently locked in their open position. Besides, that length section of the first electrode 1 which is nearest the ring 4 is covered because the coupling element 13 engages the ring 4. As a result, any electric arc which might be struck between the first electrode 1 and the contact piece 6*a* at the end 5*a* of each contact bridge will be constricted and quenched. The electric arc cannot be transferred to another region of the first electrode 1 because the sleeve 10 defines an enclosed switching chamber.

To actuate the switching element in the closing sense, the sleeve 10 is displaced opposite to the direction of the arrow 15 so that the projections 16 of the contact bridges 5 move back beyond that portion 4*c* in which the ring 4 is largest in diameter and the projections then slide down on the inclined surface 4*a* until the contact pieces 6*a* provided at the ends 5*a* of the contact bridges are again in contact with the first electrode 1. The displacement will be terminated by the engagement of the contact bridges 5 with the second inclined surface 4*b* of the ring 4.

That portion of the sleeve 10 in which the contact pieces 6*a* associated with the first electrode 1 are disposed is suitably provided with walls consisting of a material which is adapted to release arc-quenching gases under the action of an electric arc.

It is apparent from FIG. 3 that the slider 10 is integrally formed with a mounting flange, which is formed with bores 22 for securing the switching element to a mounting plate.

With the exception of the provision of an axial mounting bore 25 in the first electrode, the first and second embodiments have the same appearance in a transverse sectional view taken along line III—III in FIG. 1 so that FIG. 3 is applicable also to the second embodiment.

The second embodiment differs from the first in that the ring 4 is mounted on the insulator 3 so as to be slidable along the longitudinal axis of the electrodes 1 and 2. For this purpose the ring 4 has a central bore, which comprises a length section 2 which has a relatively large diameter, which equals the diameter of that length section 18 of the first electrode 1 which adjoins the insulator 3, and a second length section, which has a relatively small diameter, which equals the diameter of the insulator 3. The maximum displacement of the ring 4 equals the difference between the length of the insulator 3 and the smaller length of the narrower length section of the bore in the ring 4.

The length section 21 of the bore in the ring 4 has the same length as the first or axially inner length section 18 of the first electrode. That first length section 18 comprises a material which exhibits a favorable behavior under the action of an electric arc, such as Ag/W or Cu/W, or a composite material which will release arc-quenching gases under the action of an electric arc.

Figure 4:
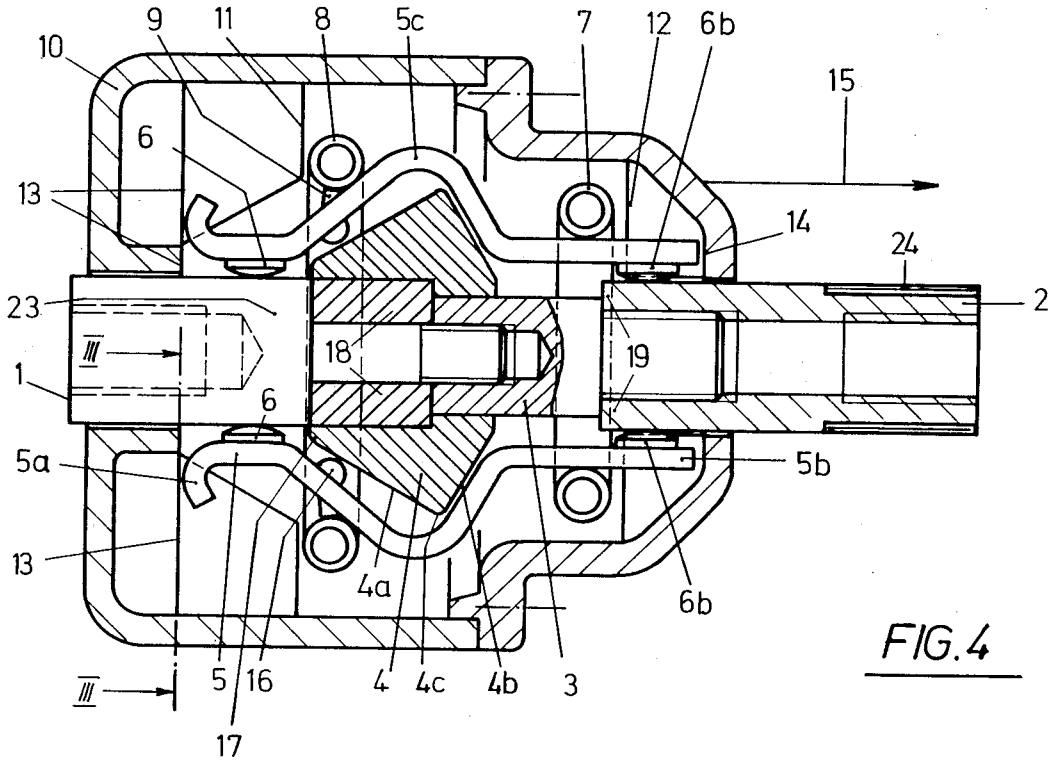
FIG. 4 is a longitudinal sectional view which is similar to FIG. 1 and shows a second embodiment of the switching element.

To actuate the switching element in the opening sense, the sleeve 10 is displaced in the direction of the arrow 15. As a result, the coupling elements 13 of the sleeve act on the ends 5*a* of the contact bridges so that the latter are displaced too. Each contact bridge 5 is provided on its radially inner side with a rounded projection 16, which is close to the projections 9 and during this displacement from the closed position shown in FIG. 4 engages the inclined surface 4*a* of the ring 4. But initially the projections 16 do not slide up on the inclined surface 4*a* but first displace the ring 4 until the latter engages an annular stop face 19 formed at the axially inner end of the second electrode 2. During that displacement the ring 4 exposes that length section 18 of the first electrode 1 which adjoins the insulator 3. The length section 18 consists of a material for electrical contacts which exhibits a favorable behavior under the action of an electric arc or of a composite material which releases arc-quenching gases under the action of an electric arc.

Figure 5:
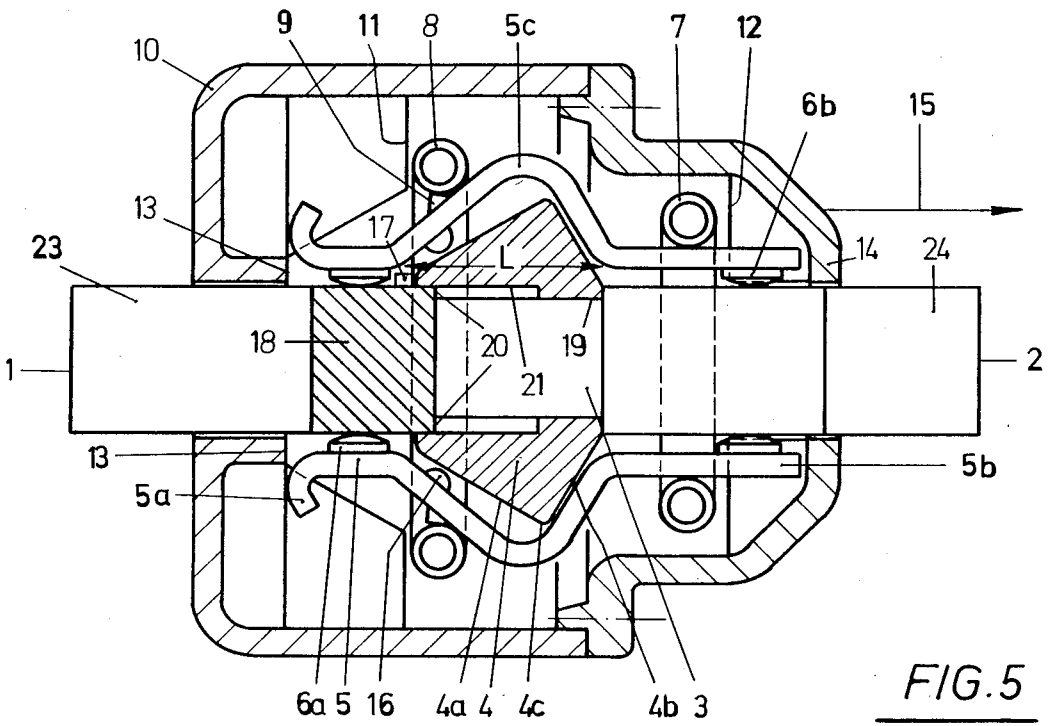
FIG. 5 is a longitudinal sectional view showing the switching element of FIG. 4 with the slider in an intermediate position.

When the ring 4 has reached the stop 19, as is shown in FIG. 5, a continued displacement of the sleeve 10 will cause the projections 16 to slide up on the inclined surface 4*a* so that the contact pieces 6*a* at the ends 5*a* of the contact bridges are lifted from the first electrode 1. The projection 16 is now moved back past the portion 4*c* in which the ring 4 is largest in diameter and slides down for a small distance on the adjoining inclined surface 4*b* until the movement is terminated in that the coupling element 13 engages the confronting annular stop face 17, which is formed on the cam 4 and rises from the periphery of the first electrode 1. The projections 16 have moved beyond that portion 4*c* of the ring 4 in which the latter has the largest diameter so that the contact bridges 5 are resiliently locked in their open position. Besides, that length section of the first electrode 1 which is nearest to the ring 4 is covered because the coupling element 13 engages the ring 4. As a result, any electric arc which might be struck between the first electrode 1 and the contact piece 6*a* at the end 5*a* of each contact bridge will be constricted and quenched. The electric arc cannot be transferred to another region of the first electrode 1 because the sleeve 10 defines an enclosed switching chamber.

If the axially inner length section 18 of the first electrode 1 comprises a material which releases arc-quenching gases under the action of an electric arc, any electric arc which is struck as the contact pieces 6*a* are lifted will be quenched quickly because the electric arc need not be driven into a quenching device as in known load-isolating switches but the quenching device constituted by the electrode 18 is moved to the contact pieces 6*a* by the displacement and will be disposed at the locations from which electric arc can be struck when the contact pieces 6*a* are lifted off. For this reason any electric arc can be quenched more quickly than in known switches if the switching element is actuated in the opening sense at a sufficiently high speed, e.g., by means of an energy storage spring.

To actuate the switching element in the closing sense the sleeve 10 is displaced opposite to the direction of the arrow 15 so that the projections 16 of the control bridges 5 initially move the ring 4 opposite to the direction of the arrow 15 until the ring 4 engages the annular stop face 20 of the first length section 18 of the first electrode 1. Only thereafter, when that first length section 18 is already covered by the ring 4, are the projections 16 of the contact bridges 5 again moved past the portion 4*c* in which the ring 4 has the largest diameter and subsequently slide down on the inclined surface 4*a* of the ring 4 until the contact piece 6*a* provided at the end 5*a* of each contact bridge has again contacted the axially outer or second length section 23 of the first electrode 1, which second length section 23 adjoins the first length section 18 and comprises a material which is highly suitable for carrying a continuous current and has a low contact resistance and a small temperature rise.

Materials which are suitable for the axially outer length section 23 of the first electrode 1 include the composite materials Ag/CdO, Ag/$SnO_2$, Ag/$SnO_2$/$In_2O_3$, Ag/$SnO_2$/$WO_3$, Ag/C and similar materials. The displacement is terminated when the contact bridges 5 engage the second inclined surface 4*b* of the ring 4.

The second embodiment differs from the first also in that an electrically insulating sleeve 24 spaced from the insulator 3 is secured to the second electrode 2. That sleeve 24 has the same outside diameter as the second electrode 2 in its remaining length. During an actuation of the switching element in the opening sense the contacts 6*b* slide on said sleeve 24 when the opposite contacts 6*a* have been lifted from the first electrode 1. The insulating sleeve 24 increases the dielectric strength of the switching element in its open position.

Such insulating sleeve 24 may also be provided on the second electrode 2 of the first embodiment of the switching element shown in FIGS. 1 and 2.

Like the second embodiment, the third embodiment of the switching element, shown in FIGS. 7 to 10, comprises two cylindrical electrodes 1 and 2, which at their adjacent ends have the same diameter in a certain length and which are rigidly interconnected by a cylindrical insulator 3. That insulator 3 has in a part of its length between the two electrodes 1 and 2 a diameter which is somewhat smaller than the diameter of the electrodes. An axially slidable ring 4 is mounted on the insulator 3 and is provided on its outside periphery with four peripherally spaced apart pairs of cams 4'. The two cams 4' of each pair are parallel to each other and receive between them one of the four contact bridges 5', 5''. The cams 4' are identical and are formed each with an inclined surface 4*a* adjacent to the first electrode 1 and with an inclined surface 4*b* adjacent to the second electrode 2.

The entire ring 4 consists of insulating material and is displaceable along the longitudinal axis of the electrodes for a predetermined distance. For this purpose the central bore of the ring 4 is divided into two outer length sections 21 and an intermediate length section. Each outer length section 21 has the same diameter as the adjoining portion of the adjoining electrode 1 or 2. The intermediate length section has a smaller diameter, which equals the smaller diameter of the insulator 3. The displacement of the ring 4 is limited by the end of the first electrode 1 and by the opposite annular stop face 19 of the insulator 3.

The first electrode 1 comprises an axially inner or first length section 18 made of a composite material which under the action of an electric arc releases arc-quenching gases. In the closed position of the switching element, shown in FIG. 7, that length section 18 is entirely covered by the ring 4.

The assembly consisting of the electrodes 1 and 2, the insulator 3 and the ring 4 is surrounded by an annular series of four contact bridges 5' and 5'', which are regularly spaced apart in the peripheral direction around the electrodes 1 and 2. Each of said contact bridges carries a contact 6'a or 6'b at one end and a contact 6''a or 6''b at the opposite end. In the closed position of the switching element the contacts 6'a and 6'b contact the first electrode 1 and the contacts 6''a and 6''b contact the second electrode 2.

The contact bridges 5' and 5'' are generally straight and span the ring 4. The intermediate portion of each contact bridge 5' or 5'' is guided between the cams 4' of one pair. The force by which each of the contact bridges 5' and 5'' is held against the electrodes 1 and 2 is exerted by a radially extending coil spring 8, which bears at one end on the associated contact bridge approximately at the middle of its length, and at the other end on a sleeve 10. Each contact bridge 5' or 5'' is provided on its radially outer side with a projection 9 for locating the coil spring 8. The sleeve 10 is slidably mounted on the electrodes 1 and 2 and encloses the annular series of four contact bridges 5', 5''. The sleeve 10 is provided on its inside peripheral surface with four pairs of laterally spaced apart walls 11, which are parallel to the axis of the electrodes 1, 2. Like the contact bridges, the pairs of walls 11 are peripherally spaced about 90° apart. Each contact bridge 5' or 5'' is received between the walls 11 of one pair thereof with a small lateral clearance so that the walls 11 guide the contact bridges 5', 5'' during the actuation of the switching element and hold them to extend in planes containing the axis of the electrodes 1 and 2.

A displacement of the sleeve 10 is imparted also to the contact bridges 5', 5''. The coupling element for engaging one end 5'a or 5''a of each contact bridge is formed by a radially and axially extending wall 13, which extends from the inside peripheral surface of the sleeve 10 near one end thereof. The coupling element for engaging the opposite end 5'b or 5''b of each contact bridge is formed by the opposite end wall 14 of the sleeve 10.

Two diametrically opposite contact bridges 5' carry preliminary contacts consisting of contact pieces 6'a and 6'b. The other two contact bridges 5'' are also diametrically opposite to each other and carry main contacts 6''a and 6''b. The contacts 6'a and 6''a in contact with the first electrode 1 are diametrically aligned. Of the contacts in contact with the second electrode 2, the preliminary contacts 6'b are nearer to the insulator 3 than the main contacts 6''b.

Each contact bridge 5' or 5'' is provided on its radially inner surface with a pin 16' or 16'', which extends transversely to the axis of the electrodes 1 and 2. In the closed position of the switching element, shown in FIG. 7, each pin 16'' which is secured to a contact bridge 5'' carrying main contacts 6''a and 6''b is closely spaced from the inclined surface 4a of the associated cam 4 and each pin 16' secured to a contact bridge 5' carrying preliminary contacts 6'a and 6'b is spaced a somewhat larger distance from the adjacent inclined surface 4a of the associated cam 4'.

Figure 10:
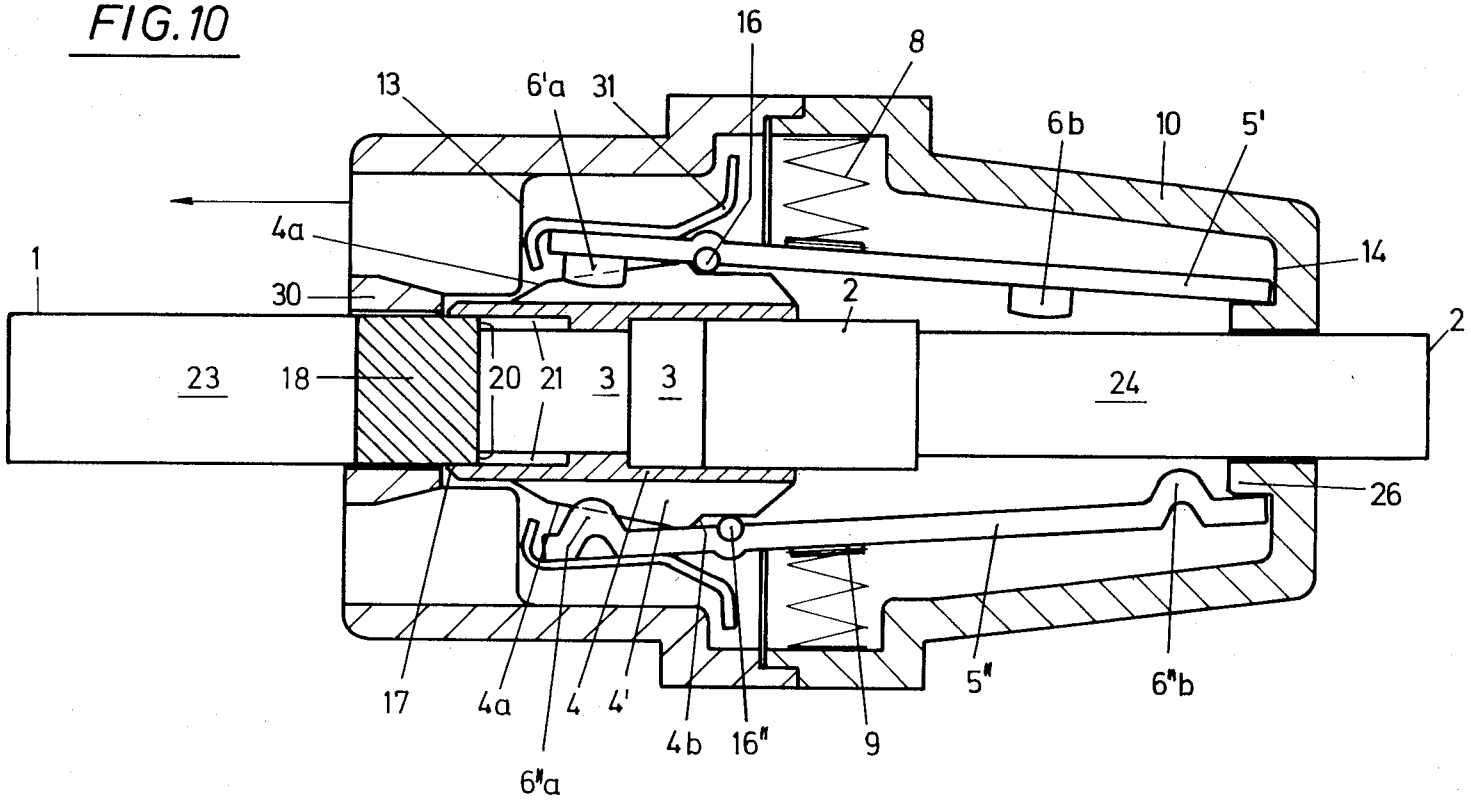

When the sleeve 10 is displaced in the direction of the arrow 15 in order to actuate the switching element in an opening sense, each pin 16'' secured to a contact bridge provided with main contacts first engages the inclined surface 4a of the associated cam 4' but initially does not slide up on said inclined surface but displaces the cam 4' so that the ring 4 is also displaced until it engages the annular stop face 19 of the insulator 3. As a result of that displacement, the ring 4 exposes the axially inner length section 18 of the first electrode. That length section consists of a composite material which is adapted to release arc-quenching gases. Thereafter each pin 16'' slides up on the inclined surface 4a of the associated cam 4' to lift the main contact 6''a from the first electrode 1. Somewhat later, each pin 16' secured to a contact bridge 5' carrying preliminary contacts engages the inclined surface 4a of the associated cam 4' and slides up on said inclined surface so that the preliminary contact 6'a is also lifted from the first electrode 1. As a result, an arc may be struck between the preliminary contact 6'a and the electrode 1. That electric arc is quenched very quickly because the composite material of the axially inner length section 18 of the electrode 1 releases arc-quenching gases, particularly hydrogen, under the action of the electric arc and said gases are blown against the electric arc and cool the same. The displacement of the sleeve 10 is continued until all pins 16' and 16'' have moved past the apices 46 of the associated cams 4' (FIG. 10). A further displacement cannot be imparted to the sleeve 10 because the end 17 of the ring 4 is engaged by a bushing 30, which is formed at that end of the sleeve 10 which is on the left in the drawing. That bushing closely surrounds the first electrode 1. By that time any electric arc struck between the electrode 1 and a preliminary contact 6'a will reliably have been quenched because the electrode 1 is covered by the bushing 30.

An approximately Z-shaped, angled sheet metal element 31 is carried by each contact bridge 5' or 5'' at that end which is near the electrode 1. The sheet metal element 31 has the same width as the contact bridge and shields that portion of the sleeve 10 which contains the contacts 6'a and 6''a from that portion of the sleeve 10 which contains the opposite contacts 6'b and 6''b. As a result, any deposition of soot which may be due to the action of electric arcs will be restricted to the portion of the sleeve 10 which contains the contacts 6'a and 6''a which are associated with the first electrode 1.

During an actuation of the switching element in the opening sense those contacts 6'b and 6''b which are associated with the second electrode 2 are also disengaged from said second electrode because the axially outer length section 25 of that second electrode is thinner than its axially inner length section disposed near the insulator 3. The contacts 6'b and 6''b are displaced to a position adjacent to the axially outer length section 25 but cannot contact that length section 25 because the end 5'b or 5''b of each contact bridge 5' or 5'' engages a projection 26 of the sleeve 10. Because the contacts 6'b and 6''b are also disengaged from the associated electrode 2, the switching element has a higher dielectric strength. The dielectric strength is further increased by the provision of an insulating coating 24 on the thinner section 25 of the electrode 2.

To actuate the switching element in the closing sense, its sleeve 10 is displaced opposite to the direction of the arrow 15 so that each pin 16' secured to a contact bridge 5' which carries preliminary contacts first engages the inclined surface 4b of the associated cam 41 and displaces the ring 4 until the latter engages the annular stop face 20 of the length section 18 of the first electrode and that length section 18 is entirely covered by the ring 4. Only thereafter are the pins 16' moved past the apices 4c of the associated cams and then slide down on the inclined surfaces 4a of said cams. Because the pins 16' secured to the contact bridges 5' which carry the preliminary contacts lead the pins 16'' secured to the contact bridges 5'' provided with the main contacts, the electrode 1 is first engaged by the preliminary contacts 6'b after the contacts 6'b and 6''b have again contacted the second electrode 2. The preliminary contacts 6'a are suitably made of materials which have a high resistance to burning. The main contacts are made of materials which are particularly suitable for carrying a continuous current and have a low contact resistance and a small temperature rise.

In the third embodiment shown in the drawing, two contact bridges carry preliminary contacts and two contact bridges carry main contacts. The switching element may be modified so that the number of contact bridges provided with preliminary contacts exceeds the number of contact bridges provided with main contacts. Such switching element will have particularly good making properties. On the other hand, a switching element in which the number of contact bridges provided with main contacts exceeds the number of contact bridges provided with preliminary contacts will have less favorable making properties but will be more suitable for carrying a continuous current.

Materials which are particularly suitable include, e.g., composite materials, such as tungsten/copper or silver/carmium oxide. The main contacts may consist, e.g., of silver-plated copper. Switching elements comprising such main contacts may be made at relatively low cost in the embodiment shown in FIGS. 7 to 10 if the contact bridges 5'' consist of copper or of a high-copper alloy and the contacts 6''a and 6''b consist of embossed and silver-plated portions of the contact bridges 5''.

We claim:

1. A switching element, particularly for use as a load-isolating switch in low-voltage switchgear, which switching element comprises contact-bridging means for electrically connecting two stationary electrical terminals, characterized in that the two terminals consist of respective electrodes (1, 2), which are coaxial to each other and axially spaced apart and are mechanically connected by an insulator (3), which is coaxial to and disposed between said electrodes, the contact-bridging means comprise at least one axially displaceable contact bridge (5), which carries two axially spaced apart, electrically interconnected contacts (6a, 6b), which are engageable with the two electrodes (1, 2) under the force of springs (7, 8), an electrically insulating cam (4) is provided on the insulator (3) under the or each contact bridge (5) and has an inclined surface (4a) facing one end (5a) of the or each contact bridge (5), a slider (10) is provided, which is axially slidable along the axis of the electrodes (1, 2) and comprises coupling elements (13, 14) for acting on respective ends (5a, 5b) of the or each contact bridge (5), said slider being reciprocable between a first position (FIGS. 1 and 4), in which the or each contact bridge (5) is in contact with both electrodes (1, 2), and a second position (FIGS. 2 and 6), in which one contact (6a) of the or each contact bridge (5) engages said cam (4) and is spaced from one of the electrodes (1), hereinafter described as the "first electrode", and the or each contact bridge (5) is adapted to slide on said inclined surface (4a) of said cam (4) during the movement of said slider (10) from said first position to said second position so as to disengage said contact bridge (5) from said first electrode (1).

2. A switching element according to claim 1, characterized in that the other electrode ("second electrode") has an electrically insulating surface portion (24) spaced from the insulator (3) disposed between the two electrodes (1, 2) and the second contact of the or each contact bridge bears on that insulating surface portion (24) in the second position of the slider (FIG. 6) and the distance between the insulator (3) and the insulating surface portion (24) of the second electrode (2) is so large that during the movement of the slider in the opening sense the or each contact bridge (5) will not contact the insulating surface portion (24) until the contact bridge (5) has been lifted from the first electrode (1).

3. A switching element according to claim 1, characterized in that the first electrode (1) comprises length sections consisting of or coated with different electrically conducting materials, an axially inner or first length section (18) adjoining the insulator consists of a material which exhibits a favorable behavior under the action of an electric arc, and an axially outer length section (23) which adjoins the axially inner length section (18) and is contacted by the or each contact bridge (5) in its first position (FIG. 4) consists of a material which exhibits a desirable behavior when flown through by a continuous current and particularly will not be weldable under such conditions.

4. A switch element according to claim 3, characterized in that the axially outer length section (23) of the first electrode (1) comprises a composite material consisting of silver-graphite (Ag/C), silver-cadmium oxide (Ag/CdO), silver-tin oxide ($Ag/SnO_2$), silver-tin oxide-indium oxide ($Ag/SnO_2/In_2O_3$) or silver-tin oxide-tungsten oxide ($Ag/SnO_2/WO_3$).

5. A switching element according to claim 3 or 4, characterized in that the axially inner length section (18) of the first electrode (1) comprises a composite material consisting of copper-tungsten (Cu/W), silver-tungsten (Ag/W), silver-tungsten carbide (Ag/WC) or silver-nickel (Ag/Ni).

6. A switching element according to claim 3 or 4, characterized in that the axially inner length section (18) of the first electrode (1) comprises a composite material which comprises a metal having a high electrical conductivity and at least one substance which under the action of an electric arc releases gases which promote the quenching of the electric arc.

7. A switching element according to claim 3, characterized in that the displacement of the slider (10), the length of the first length section (18) of the first electrode (1), which first length section (18) adjoins the insulator (3), and the length (L) of that portion of the or each contact bridge (5) which spans the cam (4), are so selected in consideration of each other that the contact (6a) which is secured to one end (5a) of the or each contact bridge (5) and is to be lifted from the first electrode will be in contact with the second length section (23) of the first electrode (1) in the first or closed position of the switching element (FIG. 4) and will have been lifted from the first electrode (1) in the second or open position of the switching element (FIG. 6) and will contact with the first length section (18) of the first electrode (1) in an intermediate position (FIG. 5).

8. A switching element according to claim 7, characterized in that the cam (4) mounted on the insulator (3) is axially slidable relative to the latter between two stationary stops (19, 20).

9. A switching element according to claim 8, characterized in that the axially inner length section (18) of the first electrode (1) is covered by the cam (4) in the closed position (FIG. 4) of the switching element.

10. A switching element according to claim 1, characterized in that the slider (10) comprises guiding portions (11, 12) and the or each contact bridge (5) is radially and axially movable and extends between said guiding portions and is guided by them on opposite sides and is held by them to extend in planes which contain the longitudinal axis of the electrodes (1, 2).

11. A switching element according to claim 1, characterized in that the slider (10) is slidably mounted on and guided by the electrodes (1, 2).

12. A switching element according to claim 1, characterized in that the slider (10) defines an internal switching chamber, particularly an arc-quenching chamber.

13. A switching element according to claim 1, characterized in that the slider (10) surrounds the electrodes (1, 2).

14. A switching element according to claim 1, characterized in that the slider (10) has surface portions which face said electrodes and the or each contact bridge and comprise a material which releases arc-quenching gases under the section of an electric arc.

15. A switching element according to claim 12, characterized in that the slider (10) comprises a perforated wall portion which defines a space containing that contact (6a) of the or each contact bridge (5) which is associated with the first electrode (1).

16. A switching element according to claim 1, characterized in that that end of the slider (10) which is disposed adjacent to the first electrode (1) is formed with one or more axially extending slots, which are adapted to receive one or more arc-quenching sheet metal elements extending axially into the gap between the first electrode (1) and that contact (6a) of the or each contact bridge (5) which is associated with and disengaged from the first electrode.

Figure 6:
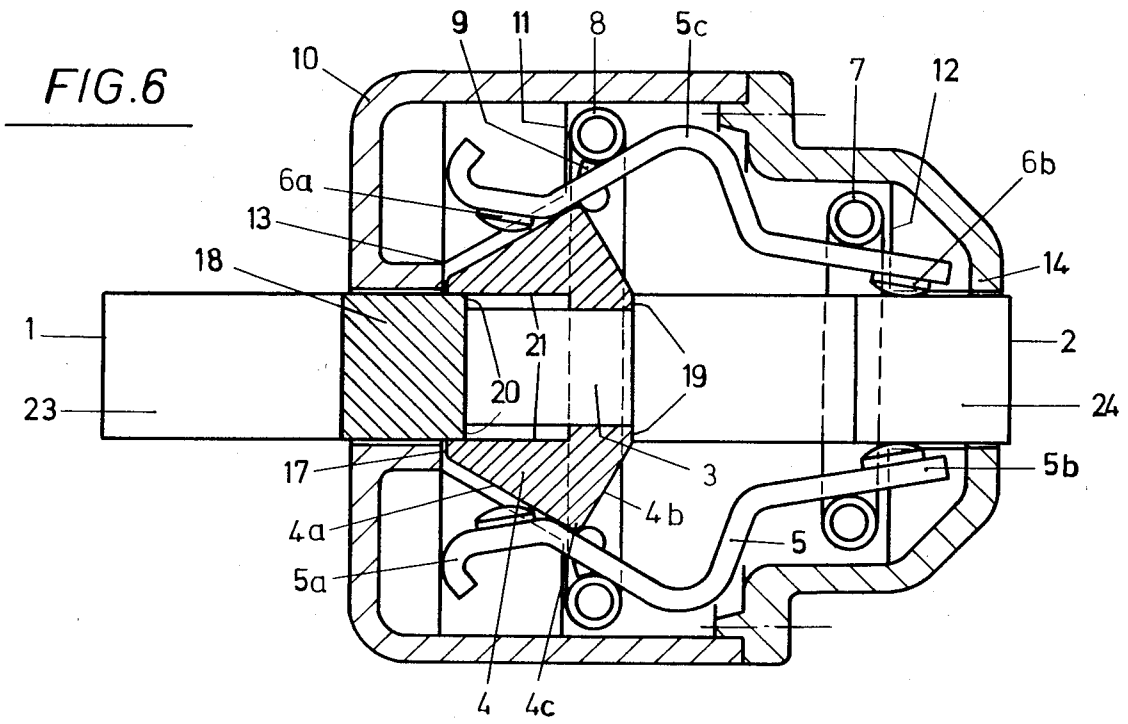
FIG. 6 is a longitudinal sectional view which is similar to FIG. 2 and shows the second embodiment of the switching element.
Figure 7:
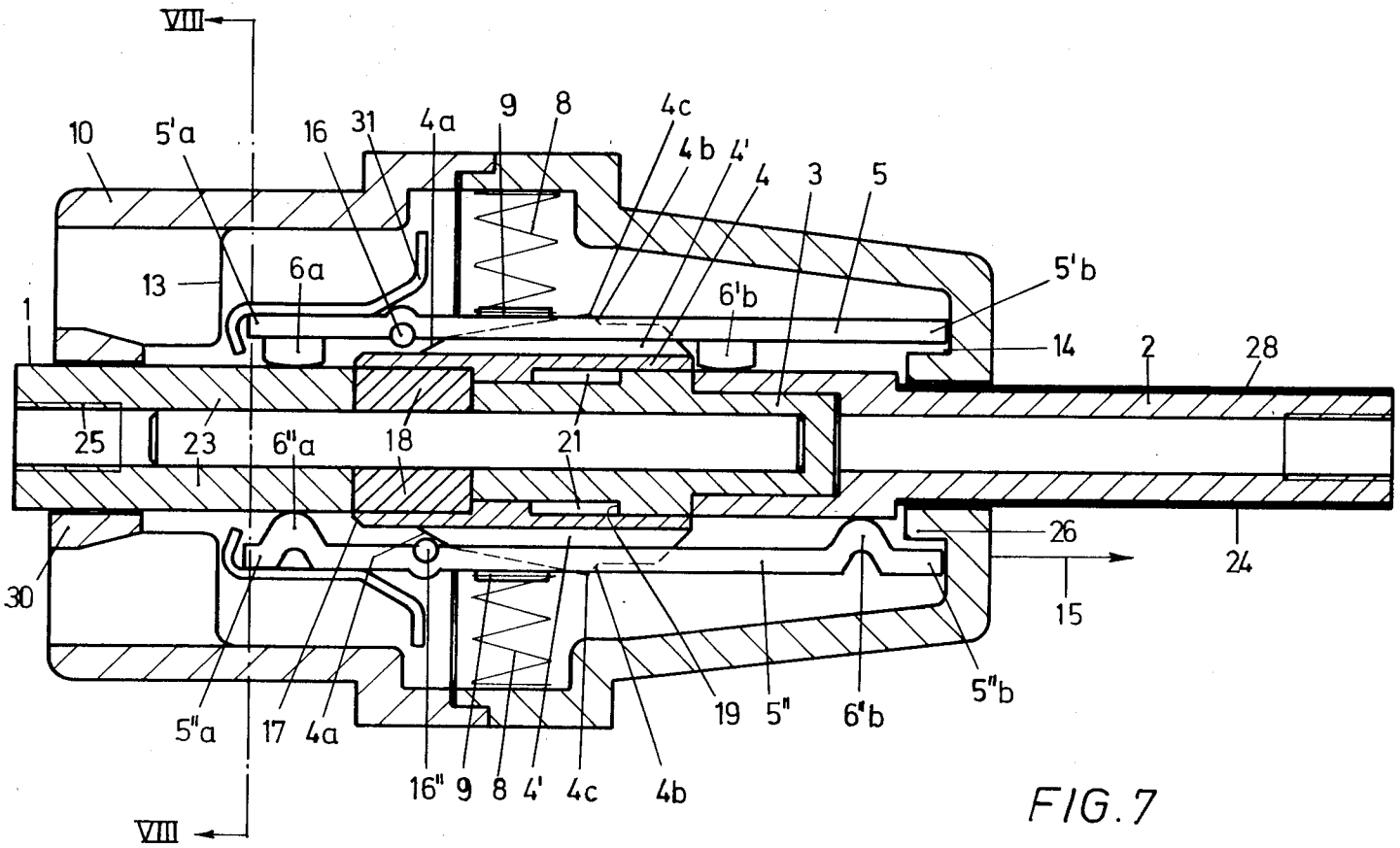
FIG. 7 is a longitudinal sectional view which is similar to FIG. 4 and taken on line VII—VII in FIG. 8 and shows a third embodiment of the switching element.
Figure 8:
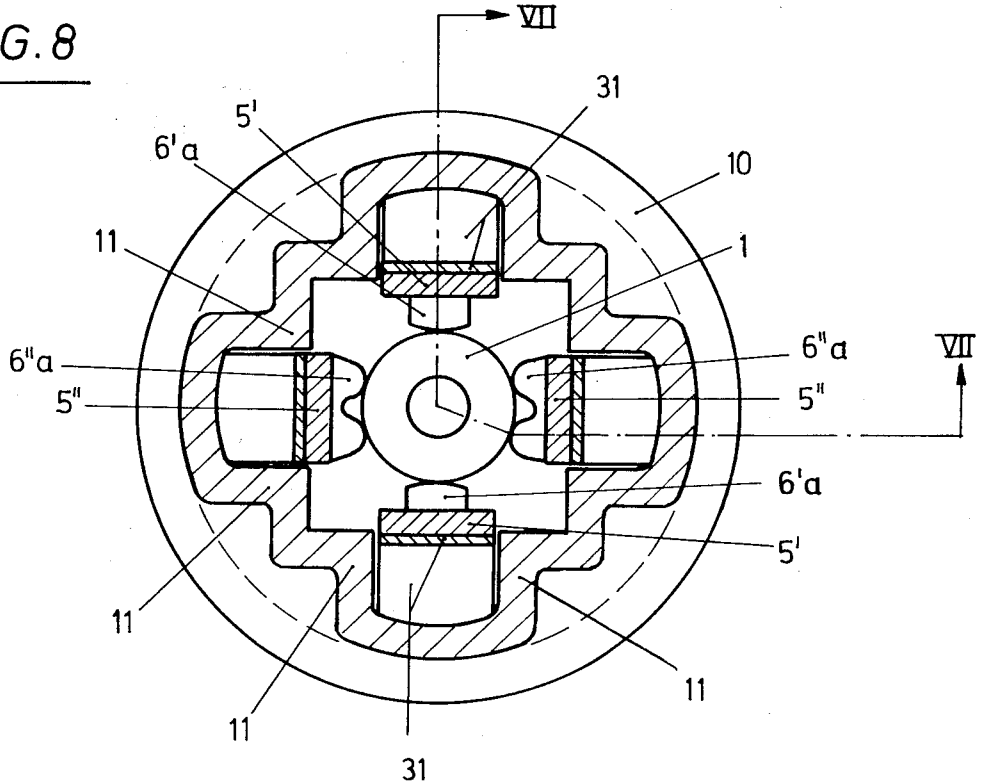
FIG. 8 is a transverse sectional view which is taken on line VIII—VIII in FIG. 7 and shows the third embodiment.
Figure 9:
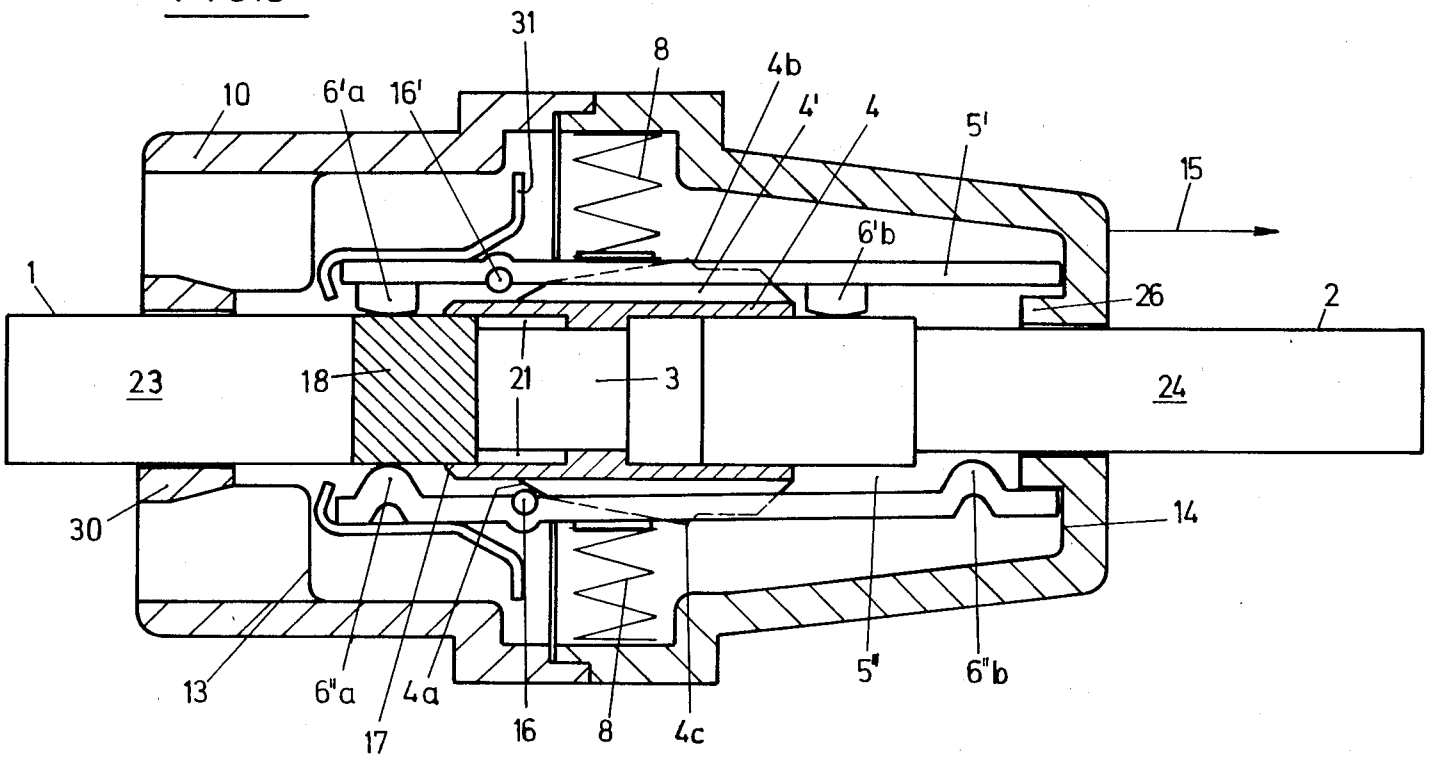
FIG. 9 is a longitudinal sectional view which is similar to FIG. 5 and shows the third embodiment and FIG. 10 is a longitudinal sectional view which is similar to FIG. 6 and shows the third embodiment.

17. A switching element according to claim 1, characterized in that the cam (4) has a second inclined surface (4b), which faces the other end (5b) of the or each contact bridge (5) and together with the first-mentioned inclined surface (4a) has the configuration of a gable roof in longitudinal section and the or each contact bridge (5) has a protection (16) bearing on the second inclined surface (4b) when the contact bridge is in its second or open position (FIGS. 2 and 6).

18. A switching element according to claim 1, characterized in that a plurality of juxtaposed contact bridges (5) are provided, which extend along the axis of the electrodes and are all displaceable by the same slider (10).

19. A switching element according to claim 18, characterized in that the contact bridges (5) constitute an annular series of said contact bridges around the electrodes (1, 2).

20. A switching element according to claim 19, characterized in that the slider (10) consists of a sleeve, which surrounds the contact bridges (5) and concentrically surrounds the electrodes (1, 2).

21. A switching element according to claim 1, characterized in that the spring by which the contact (6a) of the or each contact bridge (5) is urged toward the first electrode (1) is a leaf spring, which extends parallel to the longitudinal axis of said electrode (1), and one end portion of said spring is immovably secured to said electrode (1).

22. A switching element according to claim 21, characterized in that the other end portion of the leaf spring urges the associated contact bridge (5) toward the first electrode (1) and has been bent to extend away from the adjacent surface of said electrode (1) at an oblique angle to said surface.

23. A switching element according to claim 19, characterized in that the cam (4) consists of a ring which surrounds the insulator (3).

24. A switching element according to claim 1, characterized in that that coupling element (13) with which the slider (10) acts on that end (5a) of the or each contact bridge (5) which is associated with the first electrode engages the cam (4) when the switching element is in its second or open position (FIGS. 2 and 6).

25. A switching element according to claim 18, characterized in that each electrode (1, 2) is divided into axially extending segments, which are insulated from each other and associated with respective contact bridges.

26. A switching element according to claim 19, characterized in that a ferromagnetic ring extends radially inwardly of the annular series of contact bridges (5) and each contact bridge is straddled by a U-shaped ferromagnetic element having legs which extend on opposite sides of the contact bridge toward the ring.

27. A switching element according to claim 18, characterized in that a plurality of juxtaposed contact bridges (5) are provided and are so designed and arranged in consideration of the coupling elements (13, 14) of the slider (10) and in consideration of the cam (4) that a movement of the slider (10) in the opening and closing senses will cause at least one of said contact bridges (5) to be disengaged from and to contact at least one (1) of said electrodes after another one of said contact bridges (5).

28. A switching element according to claim 1, characterized by means (4c, 7; 8) for resiliently locking the or each contact bridge (5) in its second or open position.

* * * * *